US006629622B1

(12) United States Patent
Abzaletdinov

(10) Patent No.: US 6,629,622 B1
(45) Date of Patent: Oct. 7, 2003

(54) ADJUSTABLE WASTE MANAGEMENT SYSTEM

(76) Inventor: Rustam Abzaletdinov, 7816 Creekway Ct., Plano, TX (US) 75024

( * ) Notice: Subject to any disclaimer, the term of this patent is extended or adjusted under 35 U.S.C. 154(b) by 0 days.

(21) Appl. No.: 10/248,922

(22) Filed: Mar. 2, 2003

(51) Int. Cl.[7] ..... B65D 25/00

(52) U.S. Cl. ..... 220/495.07; 206/459.5; 220/908.1

(58) Field of Search ..... 220/495.07, 908.1; 206/459.25

(56) References Cited

U.S. PATENT DOCUMENTS 3,502,242 A * 3/1970 Du Bois ..... 220/495.07
5,704,511 A * 1/1998 Kellams ..... 220/495.07
6,199,714 B1 * 3/2001 Thompson ..... 220/495.07
6,283,321 B1 * 9/2001 Meshorer ..... 220/495.07

* cited by examiner

*Primary Examiner*—Joseph M. Moy

(57) ABSTRACT

A novel universal adjustable garbage, trash and waste management system, implemented therein as an adjustable trash receptacle, equipped with at least a cover lid supported by a gliding transformable mechanism, a dual supply feeder, and the wing-regulated adjustable opening. Said system gives a user freedom to enjoy a diversity of disposable storage media, represented by the wide variety of kitchen bags, plastic ties or sacks, independently of their brand, type, shape, size or capacity. Said system consequently improves management of garbage, trash or waste at home, in an office, or business enterprise, as well as serving family, social and outdoor, sports and other activities.

12 Claims, 17 Drawing Sheets

ADJUSTABLE WASTE MANAGEMENT SYSTEM

CROSS REFERENCE TO RELATED APPLICATIONS

The U.S. patent application 10/248,222 (Abzaletdinov).

BACKGROUND OF THE INVENTION

Known for years and widely available garbage, trash and waste management systems, especially those appliances which fall in the scope of a domestic usage, being primarily operated and managed by home users, are mostly designed to accept a certain type or brand of a waste bag, plastic tie or trash sack of a single size, as a manufacturer of the particular appliance recommends. Such situation may be beneficial for a manufacturer, but hot necessarily for the end user or customer. It is in fact a limitation, which narrows the user freedom to choose a supply media size or type. The customer has to use just a single one size or type of supply media. At minimum, it is inconvenient for the user, not to mention diminishing of supply media products competitiveness, negatively influencing market.

Often the particular brand, size, or type of a supply media that the user has to use, may not be available at the convenience store or other point of sale. To adopt, the user may try to purchase the next available size of supply media, which would most likely appear not even close to the "prescribed" specification, thus turning the user waste management experience into very unpleasant one, until the user would have the next chance to obtain the "right" supply media size or type, as required by a demanding waste management appliance.

A ballpark estimate of global scale of related feasible trouble caused by usage of said "improper" media size or type of the supply media, may potentially result in spilling waste or trash, including hazardous, as well as related user injury, time and money loss, for many users worldwide, having to struggle with the restrains of existing trash management solutions, limited by design to accept a single size or type of the supply media. Not to mention people's stress, as well as possible cases of unsanitary and other health-threatening events, which the improperly managed trash, waste or garbage substance may result in, once the needed supply media is not available, and is substituted by the wrong size or type supply media, which, we should admit, happens quite frequently in our day to day life.

Those experienced in the Art continually challenge problems in the field of garbage, trash and waste management systems, suggesting ways to improve and resolve them, no wonder the Prior Art has been enriched by a cumulative intellectual capital represented by, and not limited, to reference just few: The U.S. Pat. No. 445,719 (Schillinger), The U.S. Pat. No. 5,628,424 (Gola), The U.S. Pat. No. 5,738,239, (Triglia), The U.S. Pat. No. 5,803,303, (Timm, et al.), The U.S. Pat. No. 5,836,470 (Neelly, et al.), The U.S. Pat. No. 6,079,759 (Payne, et al.), The U.S. Pat. No. 6,126,031 (Reason),The U.S. Pat. No. 6,302,583 (Steinmetz), The U.S. Pat. No. 6,446,919, (Tsui), The U.S. patent application Ser. No. 20020003144 (Grimes), The U.S. patent application Ser. No. 20020162304 (Stravitz), in addition, many more artifact of the Art may be discovered worldwide.

Compared to the Prior Art the novel invention uniquely differentiates itself by adding value to the quality of domestic, office or business garbage, trash and waste management systems. The invention introduces a bright palette of simple, yet effective solutions and improvements to said systems. The lid gliding mechanism with transformable bars, secure joints and glider rails, the rotary wings with clickable mechanism to control the size of the adjustable opening, the dual feeder these are just few key features of the new and improved architecture design pattern applicable to any newly designed garbage, trash or waste management system, said key features could make the said system almost universal, truly user friendly, highly convenient and appealing for a modern look and pleasing feel for the user of most ages and experience levels.

Moreover, the invention expands usability of trash management systems, especially of the newly designed garbage containing and disposing means or waste management appliances, by adapting to a wide variety of kitchen bags, trash ties, plastic sacks and other disposable supply media. Subject to a newly suggested architecture design pattern said appliances could easily handle any supply media which is often sequentially compacted in packs or rolls, with or without cavity inside and includes subjects of spiral nature.

Furthermore, the invention allows simultaneous hosting of a diverse supply media sizes and types, letting the user pick them up interchangeably, thus promoting creation of a new and improved garbage containers, trashcans, wastebaskets and other stationary or mobile adaptive waste management systems.

DETAILED DESCRIPTION

A novel adjustable trash receptacle apparatus and method helps users avoid constraints of a particular size, brand or type of disposable garbage storage media such as kitchen bags, plastic ties or sacks. The invention introduces the variable size opening and all-inclusive universal design pattern, allowing the user enjoy the freedom to choose from a diverse supply media sizes, brands, types, qualities or capacities.

Figure 1:
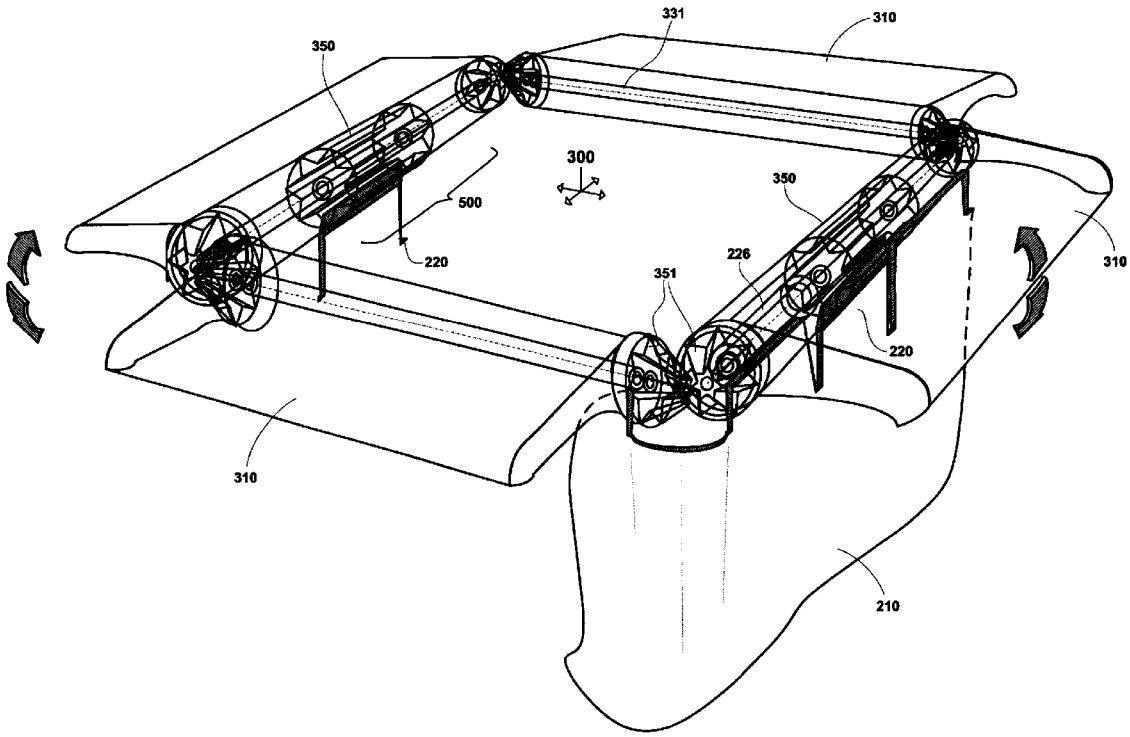
FIG. 1 depicts the wire model of the adjustable opening rotary wings with clickable mechanism and synchronization gears.

FIG. 1 therein renders new concept of variable size opening 300 formed by a plurality of rotary wings 310 coupled with at least one clickable mechanism 500 comprised of at least one gear wheel 350 and at least one tongue 220, said clickable mechanism 500 combined with a plurality of axles 331 synchronized by a plurality of bevel gears 351. Said axles 331 freely turn inside plurality of tube-like bushings 226. The tongue 220 and possibly C-shaped bushings 226 may be extruded as part of the receptacle body 210 during its manufacturing process. The tip of the tongue 220 and teeth of the gear wheel 350 may be reinforced for durability using any of the available reinforcing technologies at manufacturer choice.

Figure 2:
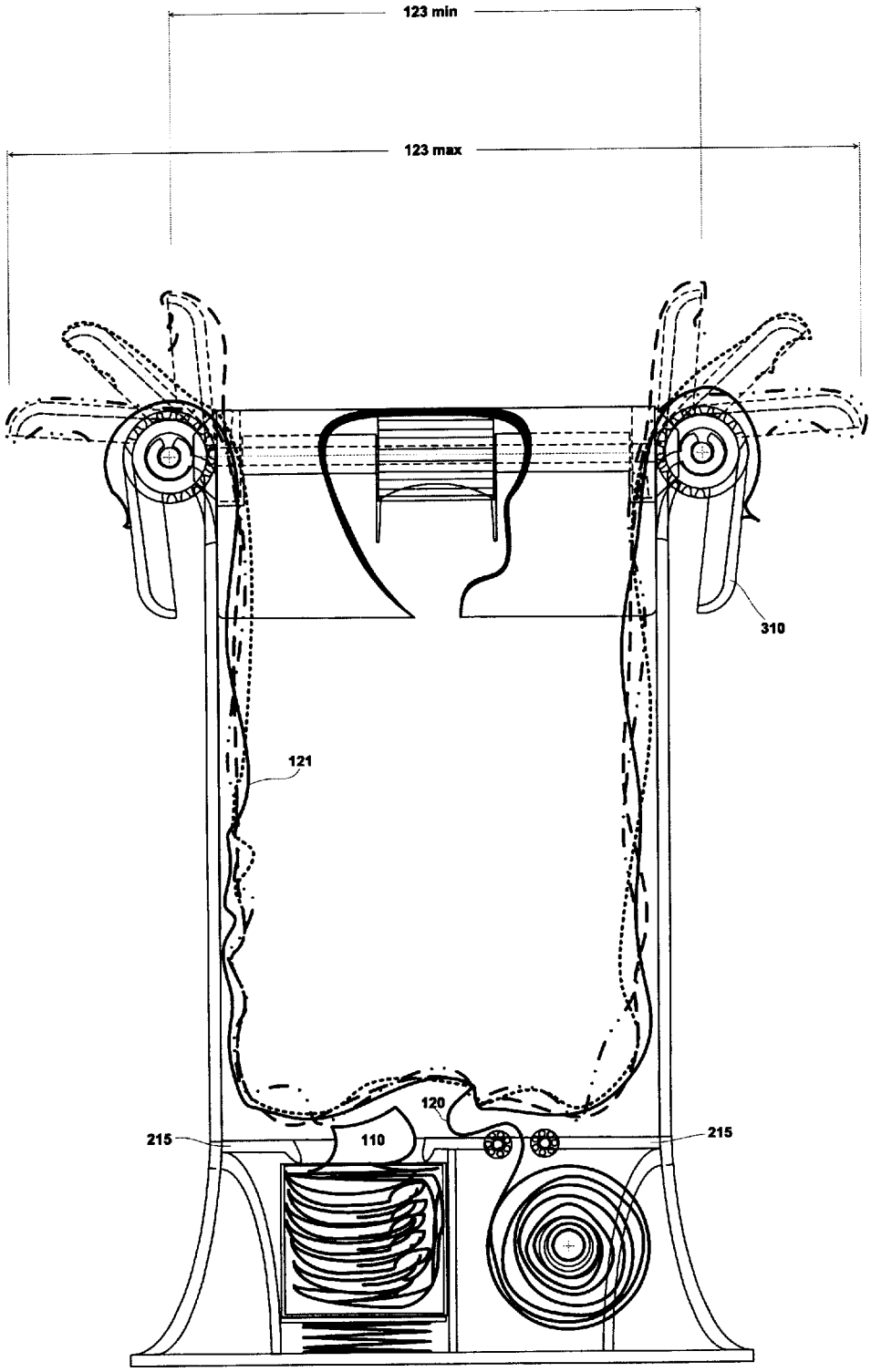
FIG. 2 shows the side view of several possible positions of the rotary wings.

FIG. 2. illustrates just a few possible positions of wings 310 to better accommodate the size of the opening 300, from minimum 123 min, to maximum 123 max, to the size of the mouth 123 of kitchen bag 110, as well as of a plastic waste tie or garbage sack 121, once either type of supply media has been pulled out from its feed-state form 120 or 110, and further expanded by the user while wrapping around wings 310 on the upper side of the perforated separation panel 215, which may be optionally extruded as part of the system during its manufacturing process.

Figure 3:
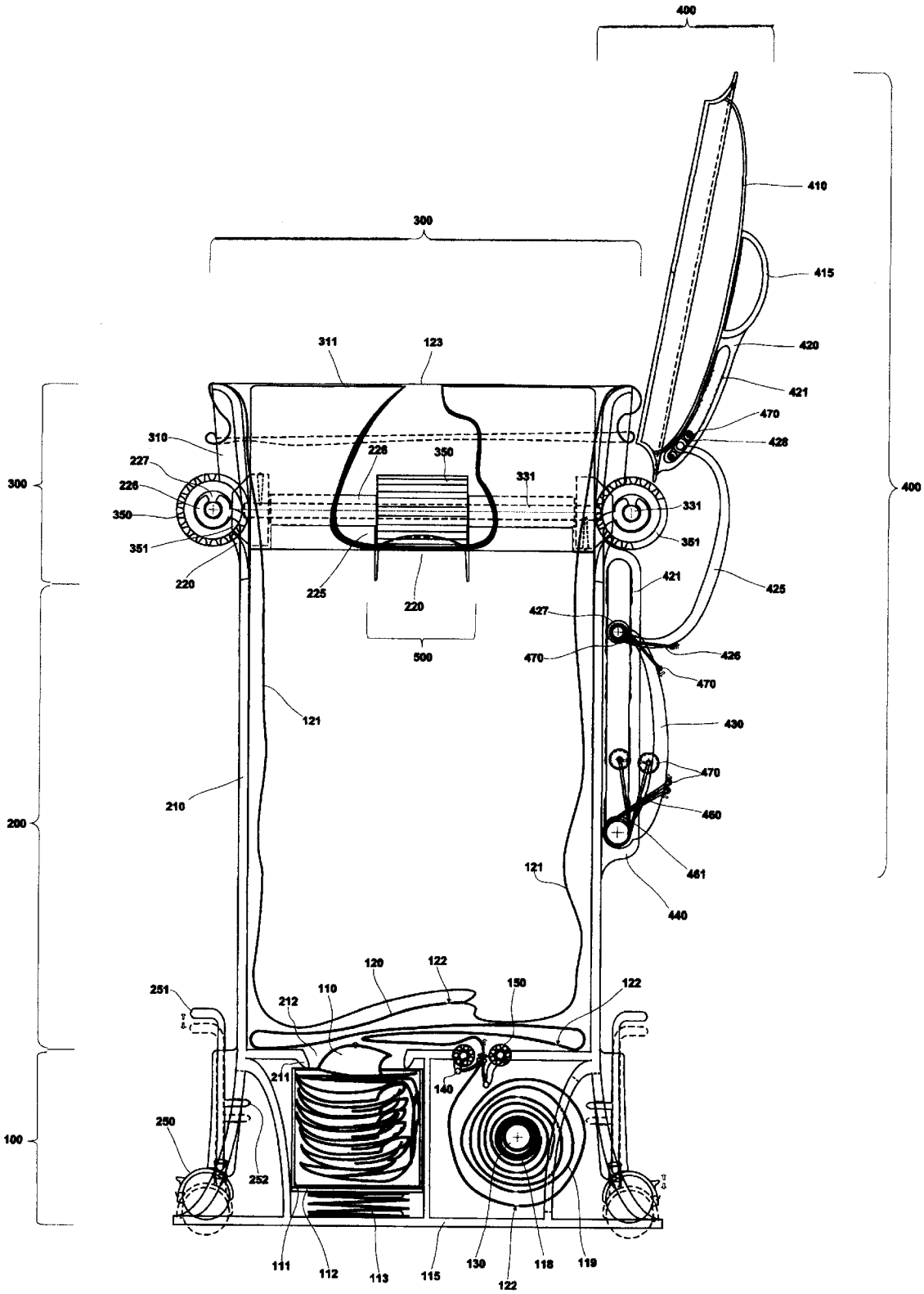
FIG. 3 depicts the detailed view of the adjustable trash receptacle.

FIG. 3 extends a view of the adjustable trash receptacle 700 including plurality of key functionality areas, namely supply media compartment 100, container stomach 200, adjustable opening 300, and cover lid glider transformable mechanism 400. Together, key areas 100, 200, 300 and 400 shape an all-inclusive architecture design pattern of the novel waste management system represented therein as an adjustable trash receptacle 700.

The adjustable opening 300 is comprised of at least one rotating wing 310 coupled with the bevel gears 351 responsible for a synchronous move of all wings 310, by means of axles 331, supporting bushings 226 and, rotary controlled by the user, clickable mechanism comprised of at least one gear wheel 350 and at least one tongue 220. Said clickable mechanism 500 helps regulate, in click-by-click controlled angles approximately 15 degrees each, the size of opening 300 to match the size of mouth 123 of the plastic bag 110, or rolled sack 120 in their expanded form 121. The bushing 226 may have an optional technological slot 227 helping insert axle 331 inside said bushing 226 during the assembly of the receptacle 700.

The user manually and rotary turns at least one or preferably two opposite wings 310, as necessary, which action, in turn, engages axles 331, causing synchronous rotation of the rest of the axles 331 and attached to them wings 310 driven by the bevel gearings 351 also attached to axles 331. Said user movement results in an orchestrated adjustment of the size of the opening 300 and fixing said size to a desired degree by clickable mechanism 500. The clickable mechanism 500 consists of a plurality of gear wheels 350 and plurality of tongues 220, said gear wheels 350 engaged together with the axles 331, which are revolving inside bushings 226. The final degree of openness and, therefore, the size of the opening 300 is secured by the at least one tongue 220 and gear wheel 350. The plurality of tongues 220 and bushings 226 may be extruded as part of the receptacle body. Finally, the perimeter of the opening area 300, formed by the plurality of the wing 310 edges 311, and orchestrated by the user's rotary action, adapts to the size of the mouth 123 of either the plastic bag 110, or plastic tie or sack 121 coming from the latter media type feed 120.

Furthermore, the lid 410 is a centerpiece of the glider transformable mechanism 400, comprised of a plurality of curved bars 425, 430, a plurality of transformable secure joints 428, 427, 461, and a plurality of glider rails 420, 440 equipped with the brake-curved friction means 421. Said rails 420, 440 maintain friction with the transformable secure joints 428, 427, 461 that are kept in a required degree of tension by the dual force action springs 426, 460, which are, in turn, coupled with the plurality of pilot wheels 470. Said pilot wheels 470 and the lid secure joint 428 experience traction of the brake curves 421, to help maintain the preferred position of the lid, as may be freely chosen by the user operating the receptacle 700, additionally by means of the lid 410 handle 415, curved bars 425, 430, and rails 420, 440 of the lid transformable glider mechanism 400.

The supply compartment area 100 is shaped as at least dual cave supply media feeder, suited to host at least either or both the roll 119 and the, possibly cardboard, box 111, with each of said supply media type most likely containing a sequential feed of supply media subjects, such as kitchen bags 110 or plastic sacks 120. Therefore, supply compartment 100 hosts a plurality of supply media of different brands, types, shapes, capacities and sizes. Furthermore, the supply area 100 on FIG. 3 may have at least one lateral door 155 shown on FIG. 17 therein, and/or plurality of cavities 152, 153 open to any side, or both the door 155 with handle 156 and cavities 152, 153, as, once again, is illustrated on FIG. 17; for ease of loading of either type of said supply media into supply area 100 shown on FIG. 3.

Furthermore, on FIG. 3, the peripheral, most likely corner edges of supply area 100, may be optionally equipped with a plurality of user operated and downwards erectable wheels 250, controlled by the user by means of one of many possible kinds of the erect mechanism 251, such that the user could secure the plurality of wheels 250 in either upward or downward position, relative to the foundation panel 115, with the help of at least one bolt 252 sliding within a curved guiding channel, which may be also possibly extruded as part of the receptacle body 210 during the receptacle 700 manufacturing process.

Apparently, the concatenated supply media 120 may be supplied by the manufacturer often perforated for ease of disjoint along separation lines 122 between adjacent sections of the supply media contiguous feed 120, thus forming a prolonged chain of ties or sacks 120 rolled around optional hub 118 which, in turn, may be mounted by the user on at least one, optionally removable, hub axle 130, may be just one from a possible set of several interchangeable hub axles 130, also characterized by a plurality of diameters and lengths to fit a diversity of dimensions of different roll hubs 118. Said set of axles 130 may or may not come with, or sold separately from the trash receptacle 700.

Alternatively, the supply feed may be represented by a hub less roll 119 that does not have a gap or cavity to accept the optionally removable hub axle 130, therefore, the latter may be safely dismounted by the user from the feeder area 100, to let her insert the hub-less roll 119 inside the supply compartment 100. In case of the hub-less roll 119 the feeder compartment may be equipped with a plurality of optional tubular bearings 160 as shown on FIG. 17, said prolonged tubular bearings may be similar to at least a pair of tubular wheels 150 as shown on FIG. 3, said bearings 160 on FIG. 17 may be located on the bottom of the feeder area 100 on FIG. 3, and based off either the platform 115 or any of the side walls of the feeder area 100, to support and help rotation of the hub-less roll 119.

Additionally FIG. 3 renders an optional supply media brake 140, described in detail in the referenced the U.S. patent application Ser. No. 10/248,222, said media brake 140 may or may not be pre-manufactured together with the container body 210 or perforated separation panel 215 shown on FIG. 2.

Figure 17:
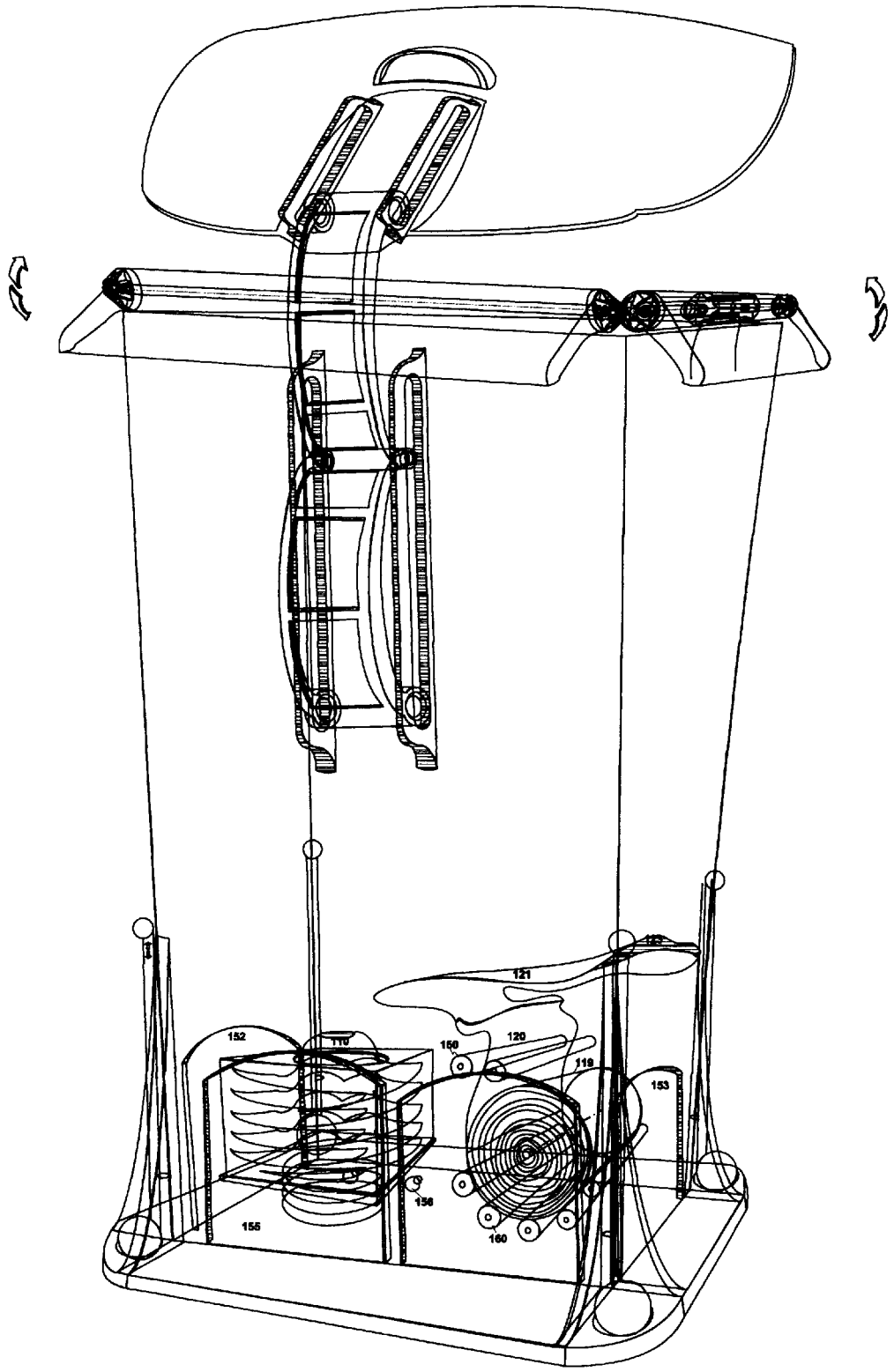
FIG. 17 shows one of the possible implementations of the novel waste management system architecture design pattern applied to a new adjustable trash receptacle.

Furthermore, as illustrated on FIG. 3 therein, the supply media feed may be represented by a collection of individual separated plastic bags 110 sequentially compacted in an original cardboard box 111, which could be easily inserted by the user, via the said side door or cavern 155 on FIG. 17. The box 111 on FIG. 3 may be inserted in the feeder area 100, and put by the user on the top of the box 111 support platform 112, such that said cardboard box 111 is secured between the plurality of teeth 211 forming an oval, rectangular or other free-form shape opening 212, helping the user access the bag 110, and the support platform 112. The expansion force of spring 13 pushes platform 112 against the foundation basement panel 115 and in the upper direction, thus supporting box 111 in the closest proximity to the opening 212, and against the teeth 211, thus readily exposing the content of the cardboard box 111 to the user.

Figure 4:
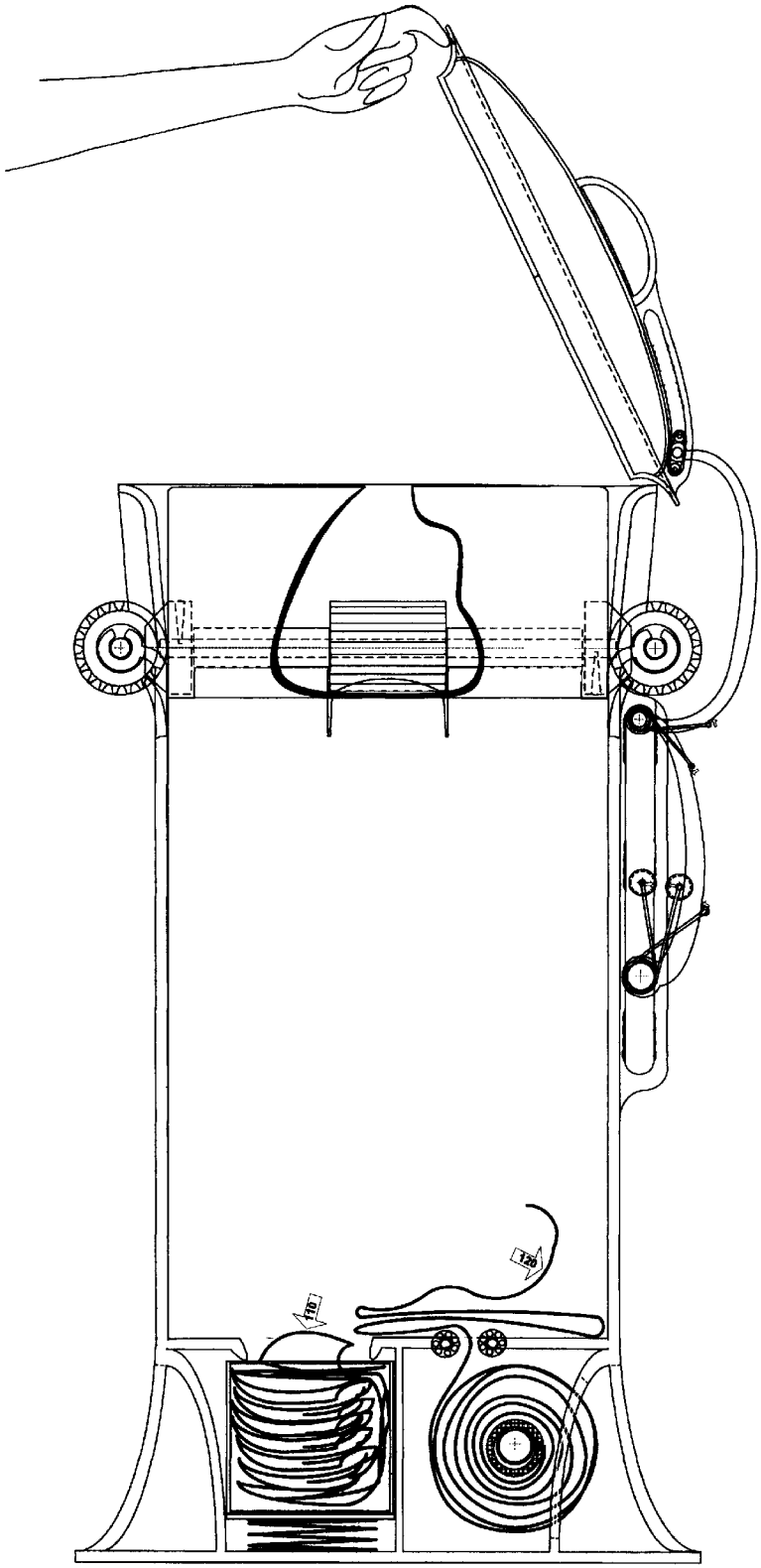
FIG. 4 renders the position of the user hand easily opening thy lid.

FIG. 4 illustrates the user easily opening the cover lid to access the bag 110 or the sack 120.

Figure 5:
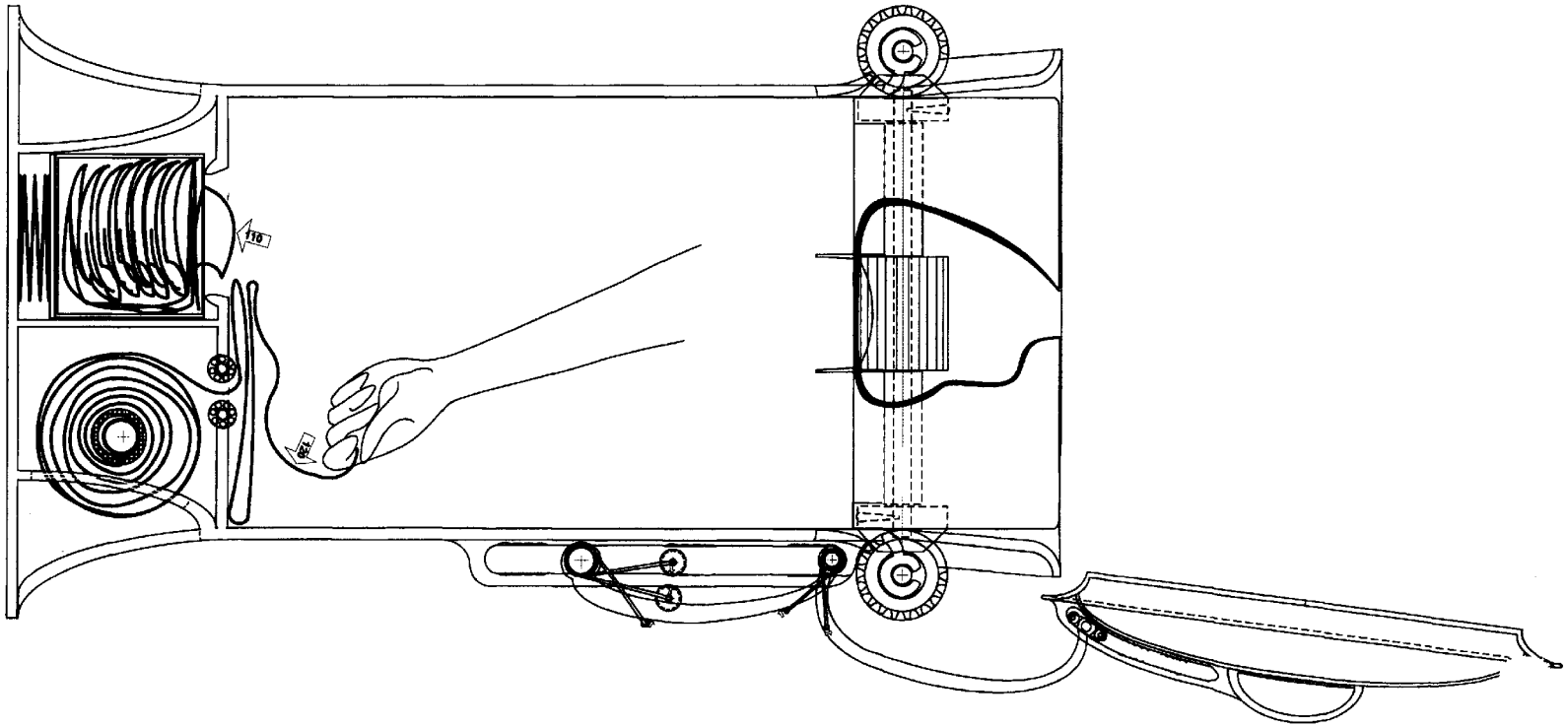
FIG. 5 extends the further move of the lid allowing the user pick up her choice of the supply media type from the dual feeder.

FIG. 5 shows the lid in an open position allowing the user penetrate inside the receptacle and choose the feed of sacks 120 as the current media type; she also has an option to pick up the plastic bag 110.

Figure 6:
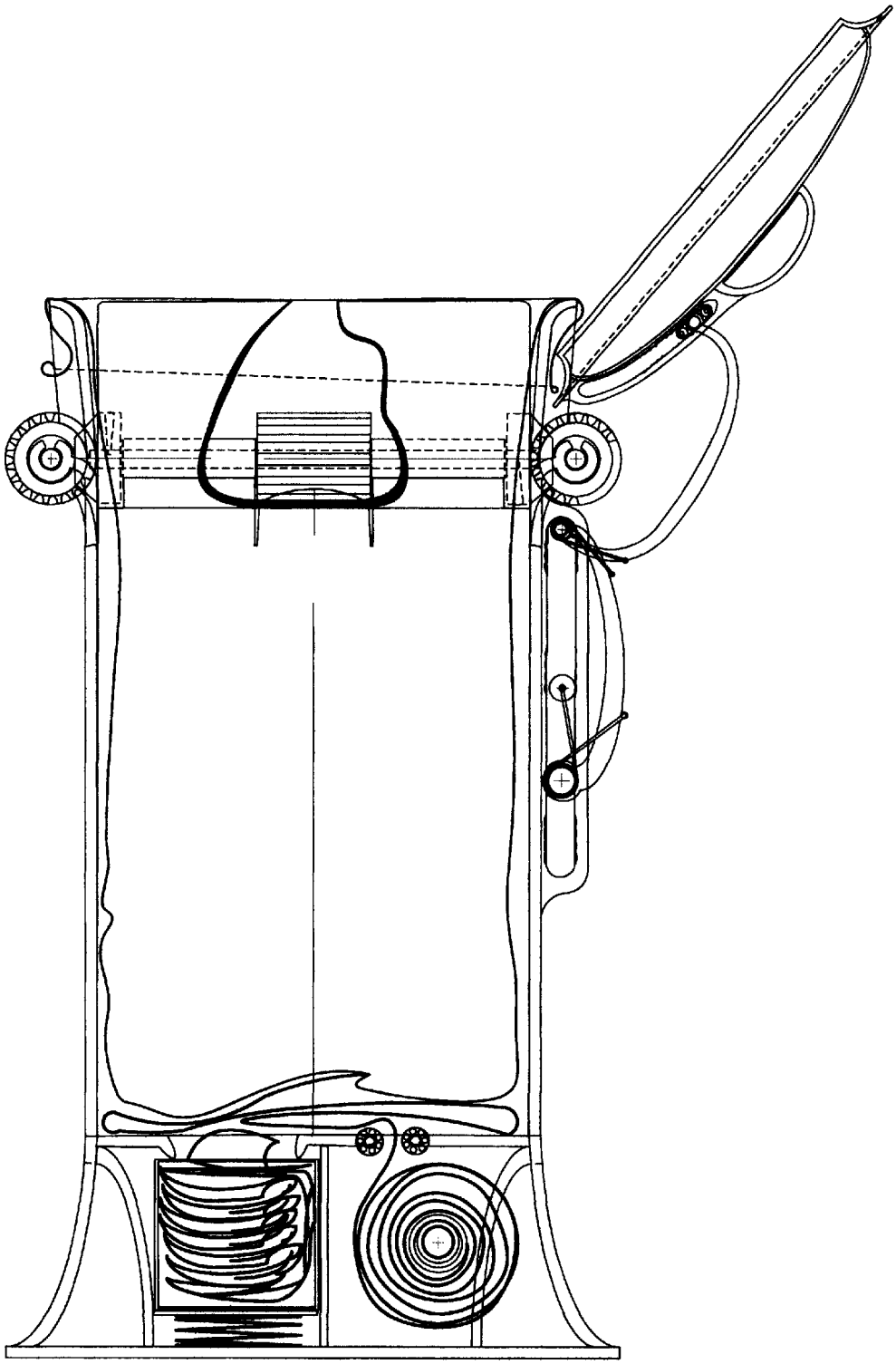
FIG. 6. shows the lid in its extreme open position.

On FIG. 6, the sack has been moved up, expanded and wrapped around the receptacle opening. Notably, the cover lid is not an obstacle during this operation as the cover lid gliding transformable mechanism provides for the greater freedom to open the lid.

Figure 7:
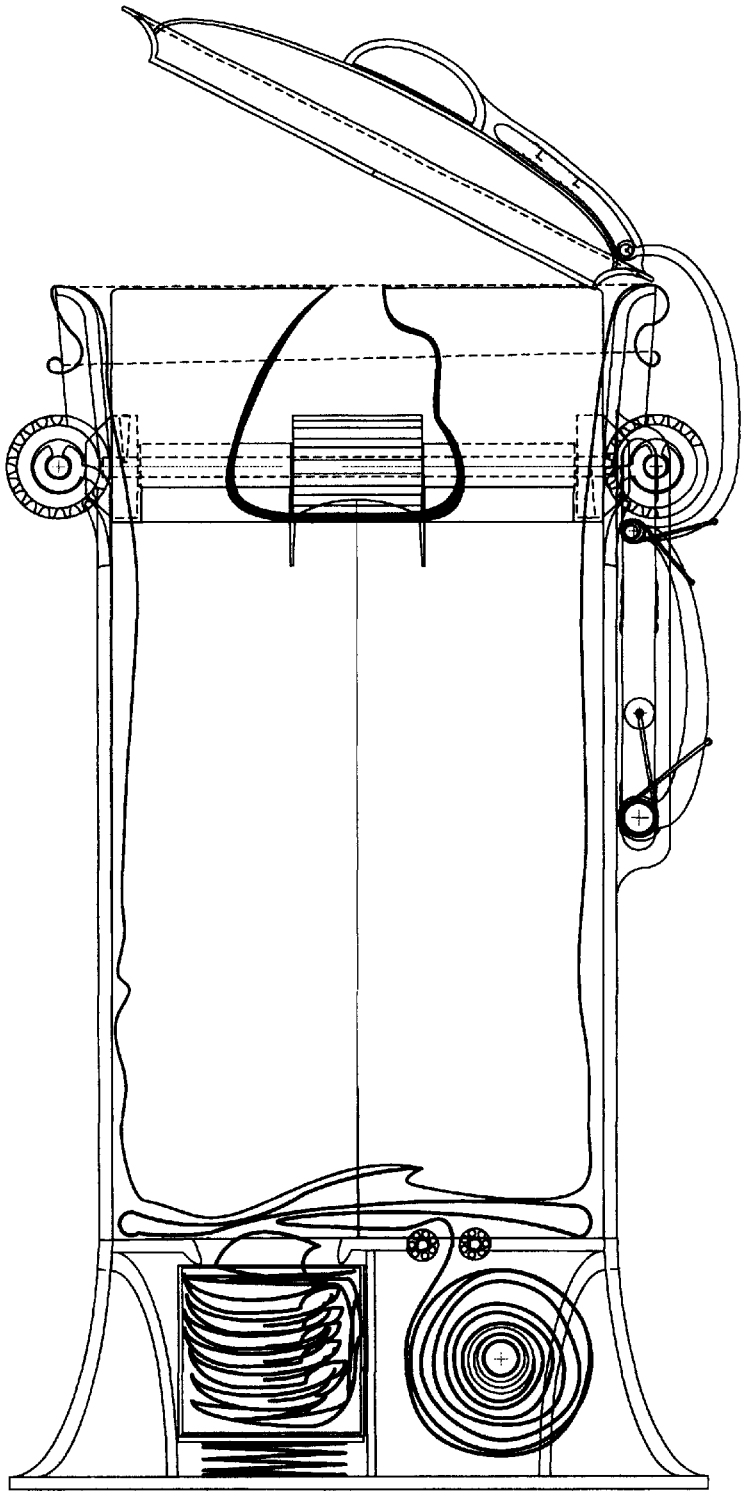
FIG. 7 shows the lid on its way to the closed position.

FIG. 7 unleashes the further closing movement of the lid stabilized by the gliding transformable mechanism.

Figure 8:
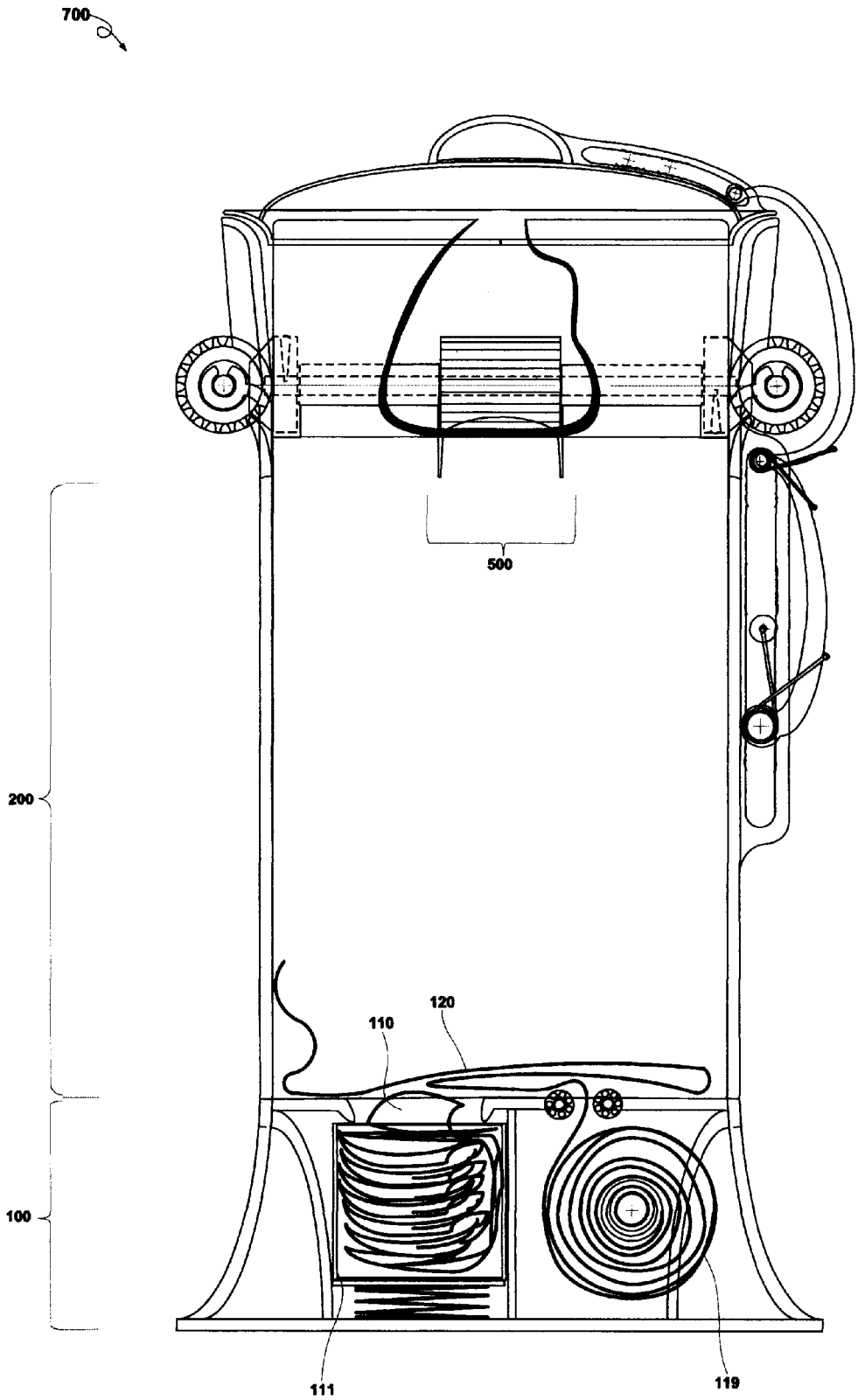
FIG. 8 renders the receptacle with the completely closed lid.

FIG. 8 therein renders the trash receptacle 700 loaded by the user with both supply media types such as plastic bags 110 stored in the cardboard box 111 and sack feed 120 supplied from the spiral roll 119. The bag or sack loading movement may be undertaken by the user preferably via at least one convenient door or door less plurality of loading cavities 155 as appears on FIG. 17, said doors, cavities 155 and additional caverns 152, 152 may be pre-manufactured in the plurality of walls of the supply compartment area 100 on FIG. 8, simultaneously said door or door less cavity 155, or plurality of caverns 152, 153 on FIG. 17, may optionally partially or entirely extend the geometry contour onto the wall of the container body 200 on FIG. 8, as needed for the greater user convenience while loading and gliding the supply media of any kind into the required initial position in the supply feeder area 100.

Figure 9:
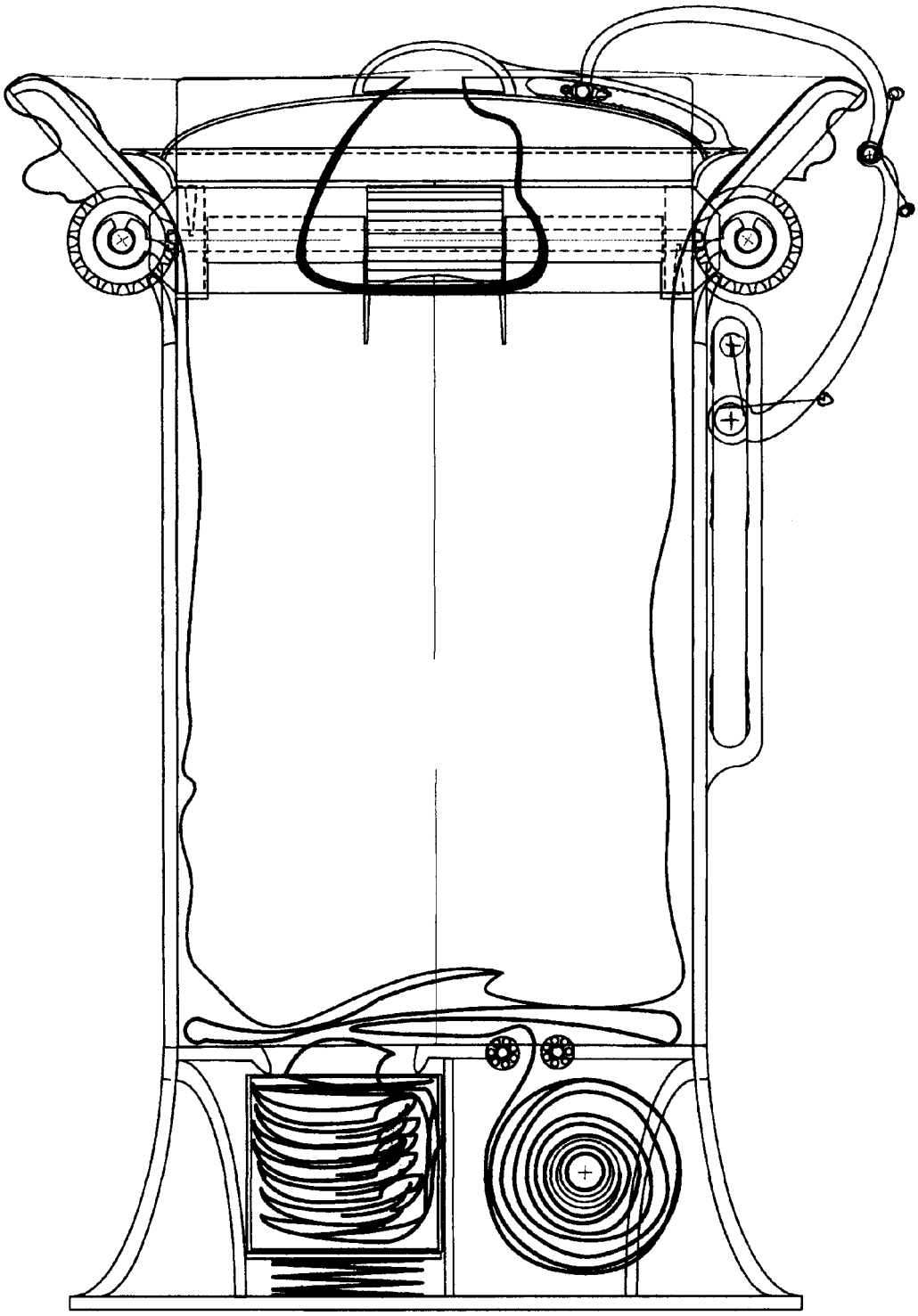
FIG. 9 illustrated the ability of the receptacle opening and the lid to adapt to a bigger size mouth of alternative supply media.

FIG. 9 therein illustrates the sack feed has been untied into the sack bag. The user has completed the preparation cycle by conveniently wrapping the bag mouth precisely and securely, applying necessary tension around outer edges of rotary wings, and, if necessary, further fine-tuning the size of the receptacle opening by rotating said wings in clicks of said tongue against said gear wheel, achieving closest match of the outer perimeter of the receptacle opening and the perimeter of the bag mouth, resulting in a most secure position of the supplied bag or sack within the trash receptacle.

Figure 10:
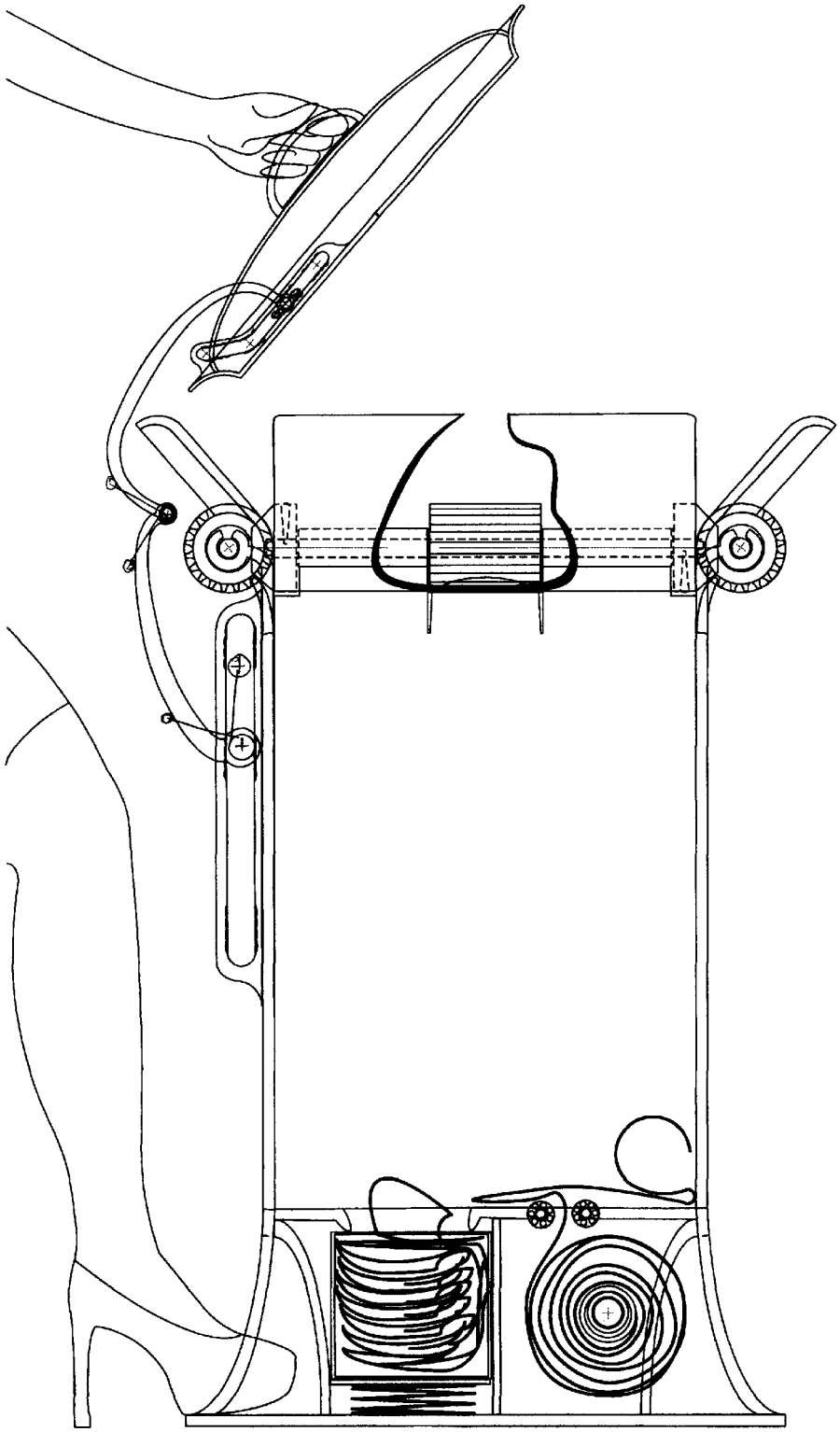
FIG. 10 illustrates the flexibility of the lid gliding transformable mechanism.

FIG. 10 shows the user opens the lid to, most likely, reach the supply media from the bottom of the receptacle. Notice the new positioning of the lid gliding transformable mechanism, and the rotary wings preset by the user to form about 45 degree opening.

Figure 11:
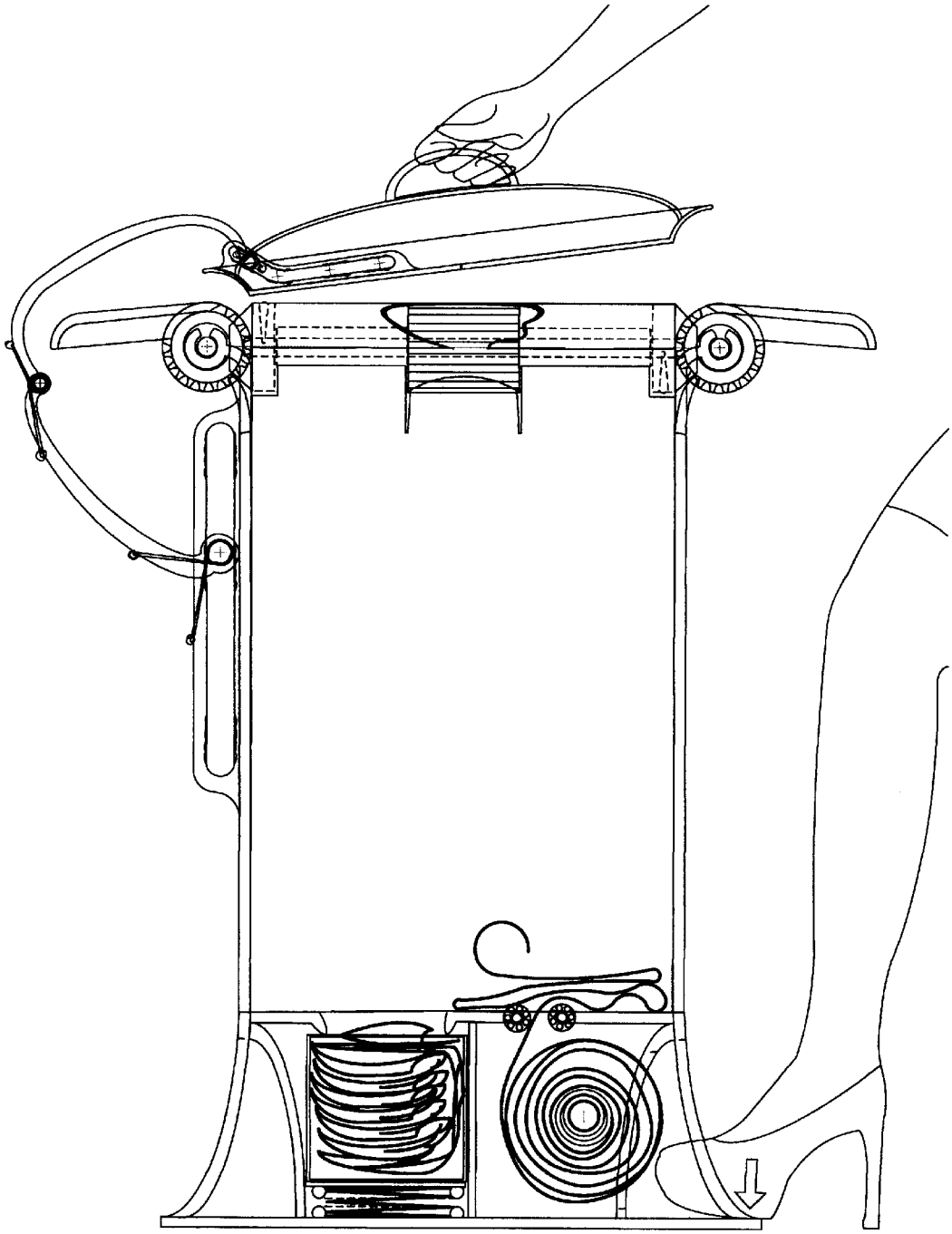
FIG. 11 is similar to FIG. 10 with the user approach the receptacle from the other side to open the lid.

FIG. 11 presents the user moving the lid of the adjustable trash receptacle further to close position.

Figure 12:
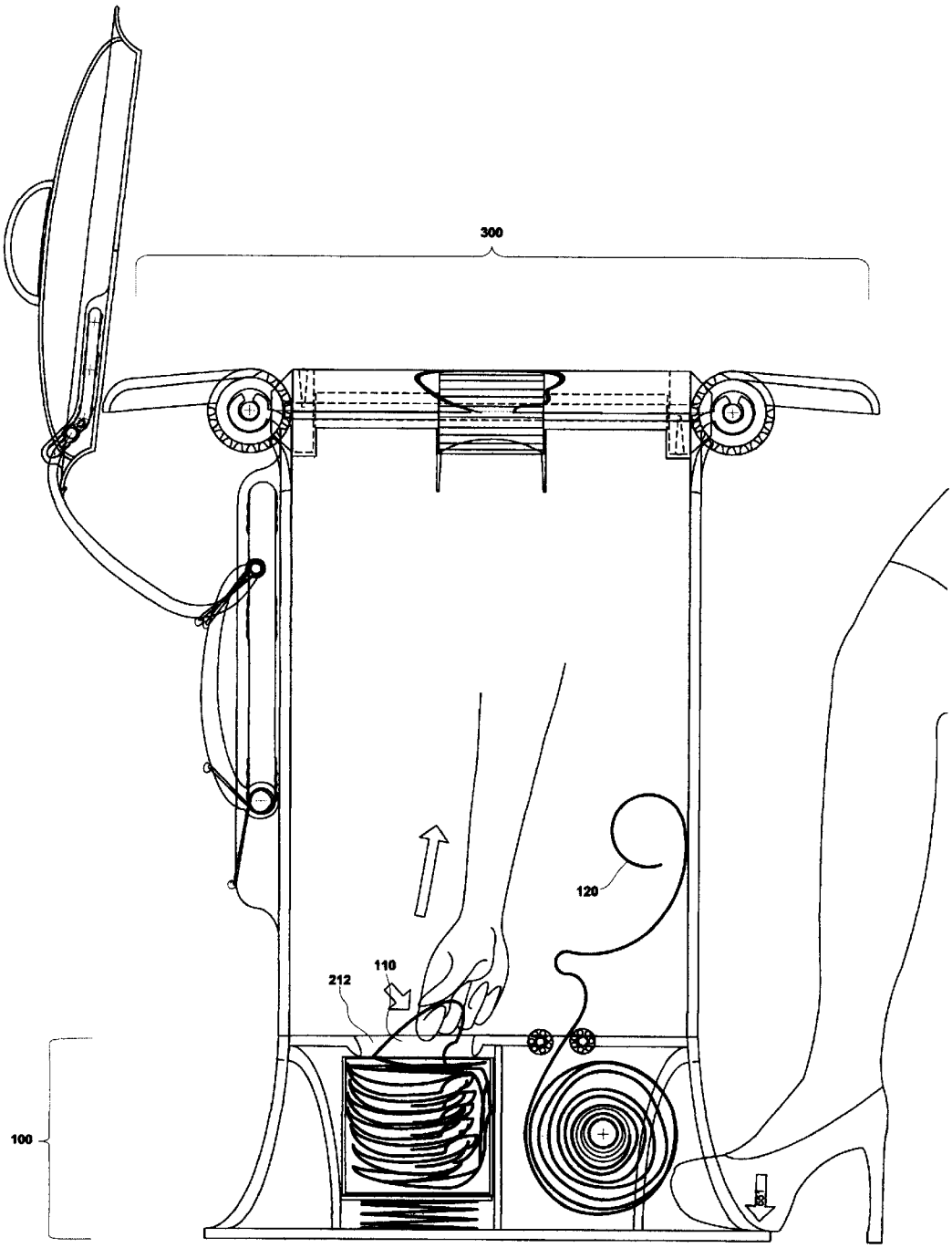
FIG. 12 illustrates the receptacle ability to maximize the size of the adjustable opening to let the user prepare for choosing the bigger size and alternative type of the supply media.

FIG. 12 illustrates the user hand reaching through receptacle opening 300 to grab either a sack feed 120, or even further, via the opening 212 to grab the plastic bag 110 from the supply compartment area 100. The media chosen by the user happens to be plastic bag 110, which will be pulled up and out opening 300 for further wrapping around plurality of rotary wings.

Figure 13:
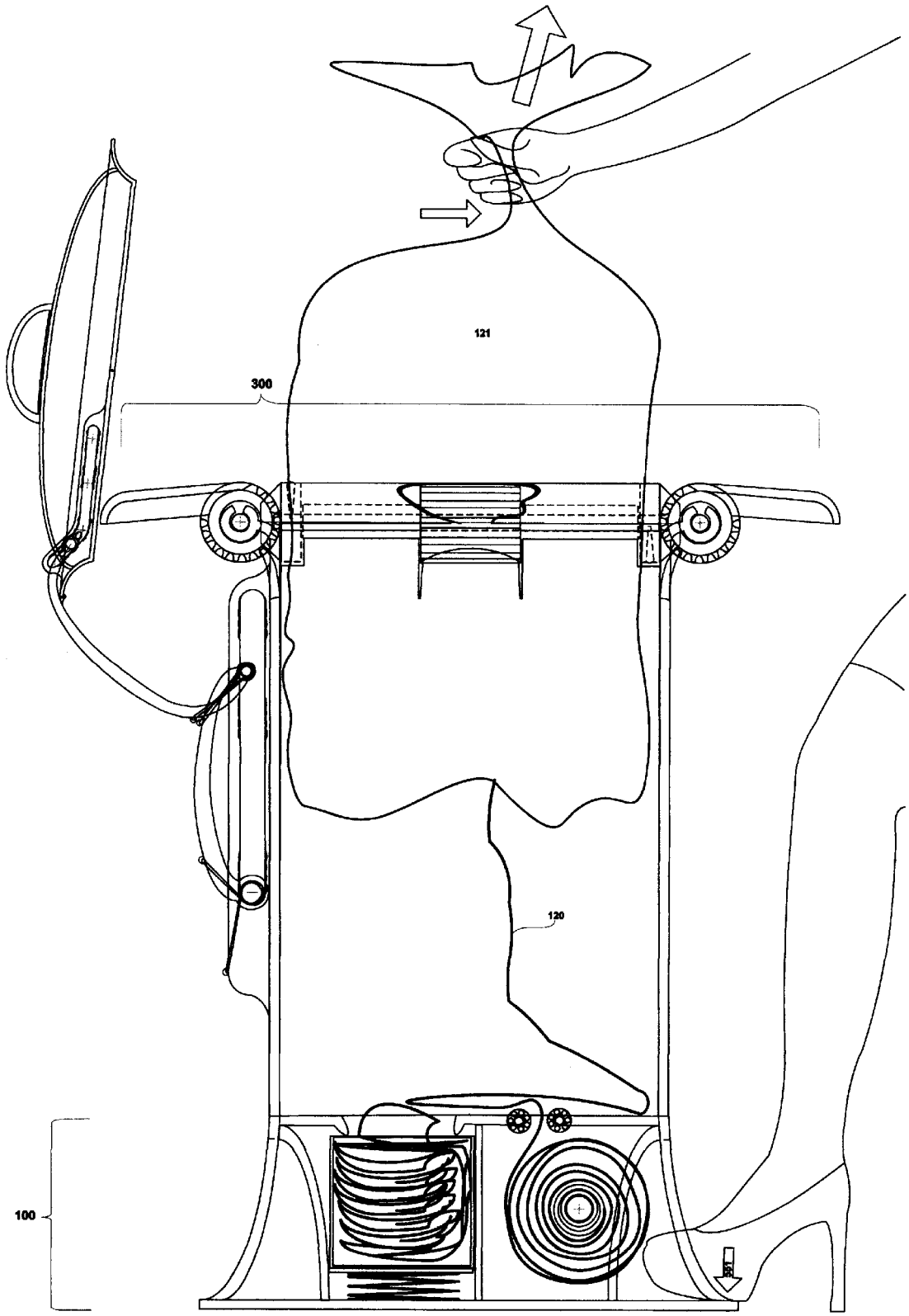
FIG. 13 depicts the user extracting the filled trash sack.

FIG. 13, further demonstrates the bottom supply feeder area 100, which, as indicated on FIG. 17 has a plurality of cavities 152, 153 for the user foot to step on the foundation of the feeder 100, to keep the adjustable trash receptacle stable while the user, as appears on FIG. 13, keeps her foot developing a natural force pressing down in the direction indicated by arrow 551, and pulling full sack 121 up and out through the receptacle opening 300.

Figure 14:
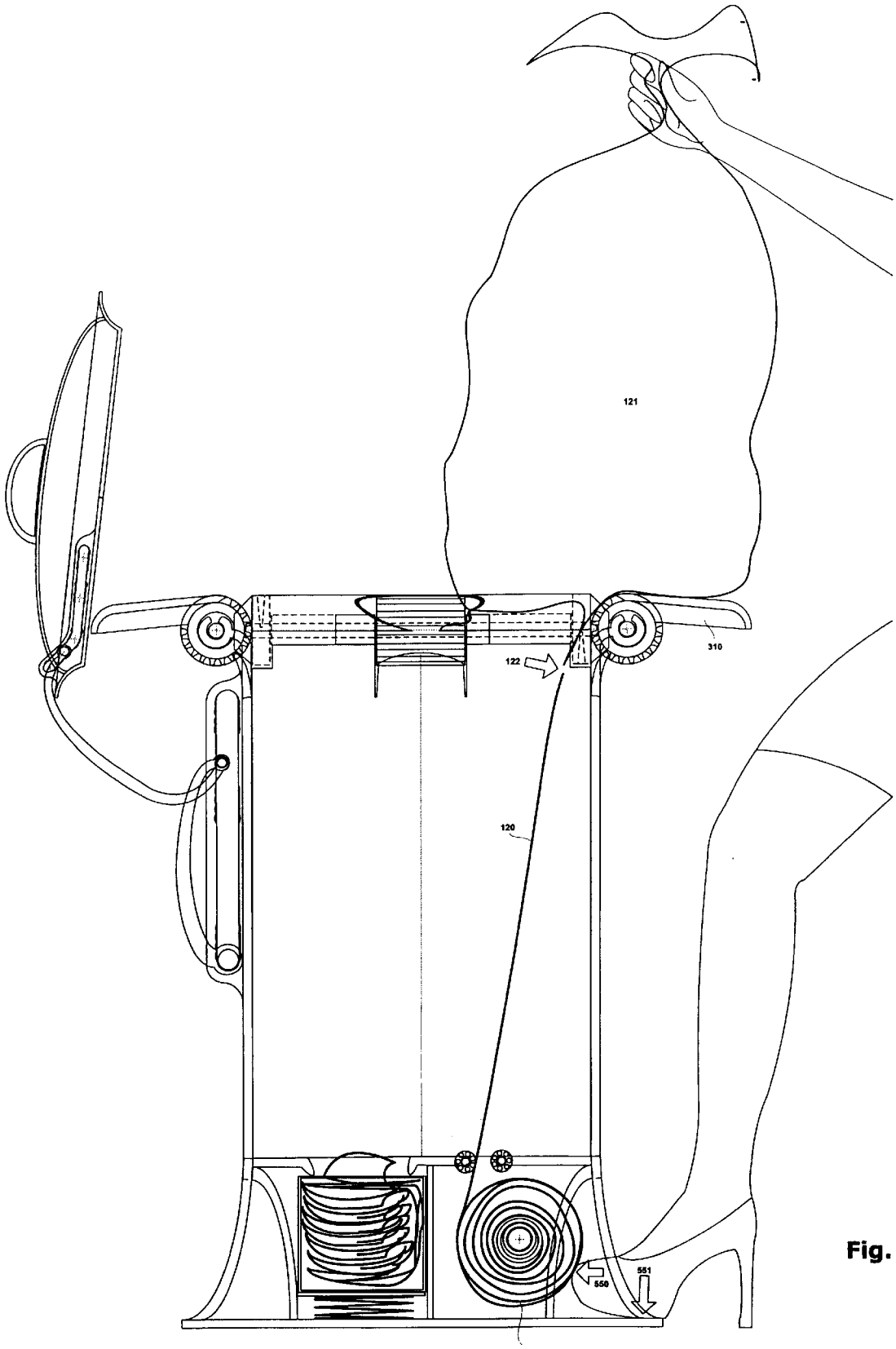
FIG. 14 shows the support of the one of the several secured rotary wings, to help user make the side move of the sack, and ease the user job of separating the filled sack from the subsequent empty one along the separation line.

FIG. 14 illustrates the user foot penetrating horizontally, in direction 550, and simultaneously keeping the down force 551 to control the rotation of the tie or sack roll 119 by variation the horizontal force in direction 550 up to a complete stop of the roll 119, thus optimizing the tension force along dividing perforation line 122 of the supply media feed 120, finally to force the filled bag 121 separate from the empty one in the feed 120, when the filled bag 121 is being removed by the user, with the additional supporting role of the rotary wing 310 helping the user to manage the weight of the full sack or bag 121. Once again, to free the filled bag 121 from the empty "tail" 120, the user initiates the disjoint of the media feed 120 from the sack bag 121 along the perforation line 122, which is weakened by the separation event tension as enforced by the tip of the user foot applying a stopping force 550 against the roll 119, and the user hand concurrently pulling the bag 121 up and out; additionally the closest to the user wing 310 provides for a convenient support of the full and likely relatively heavy bag 121, during the separation process at weakened perforated separation line 122.

Figure 15:
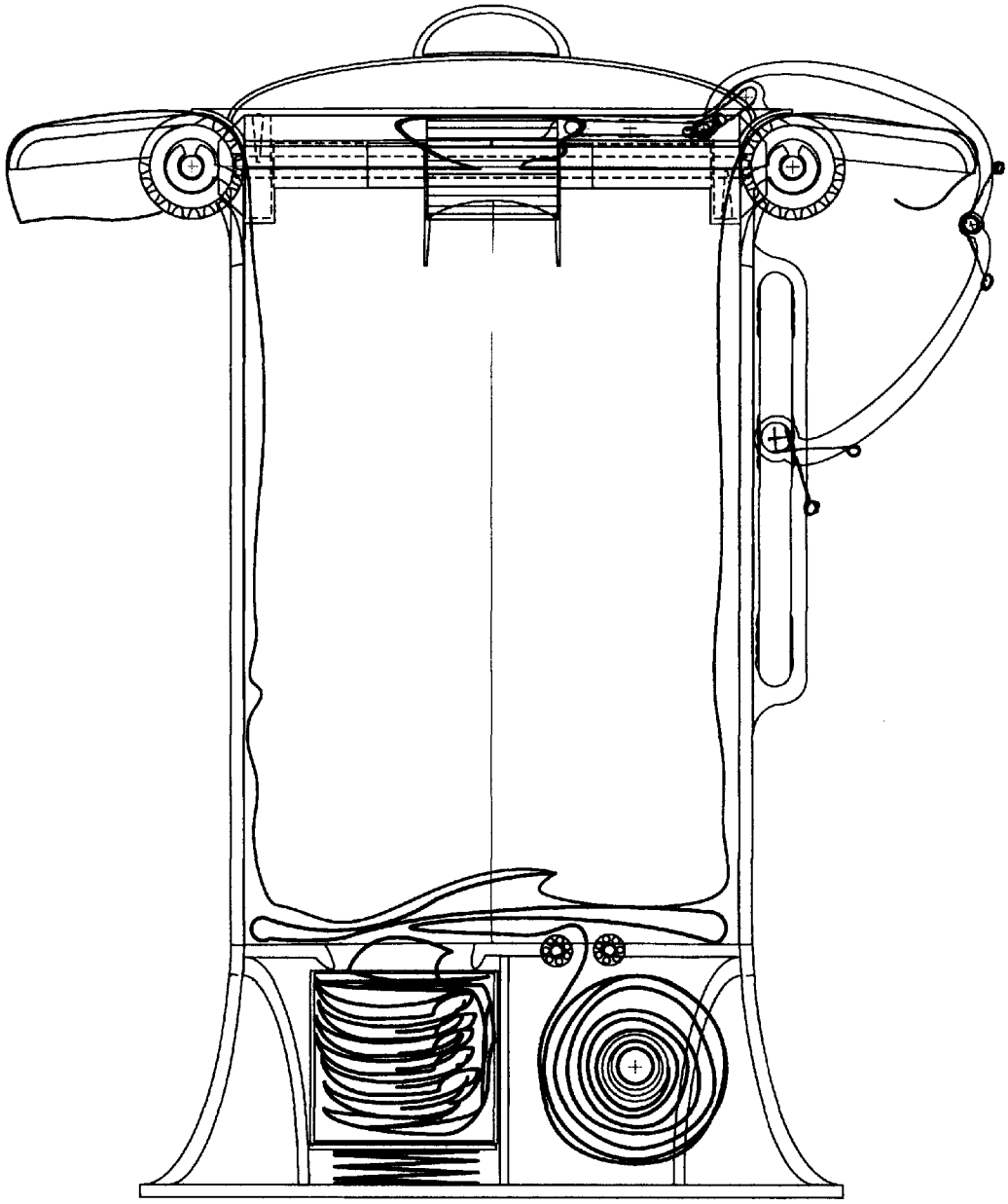
FIG. 15 is similar to FIG. 8 but shows the receptacle adjusted to the maximum size of the supply media item.

FIG. 15 therein illustrates the tension of the mouth of the disposable bag or sack wrapped around adjustable opening of the trash receptacle and covered by the lid.

Figure 16:
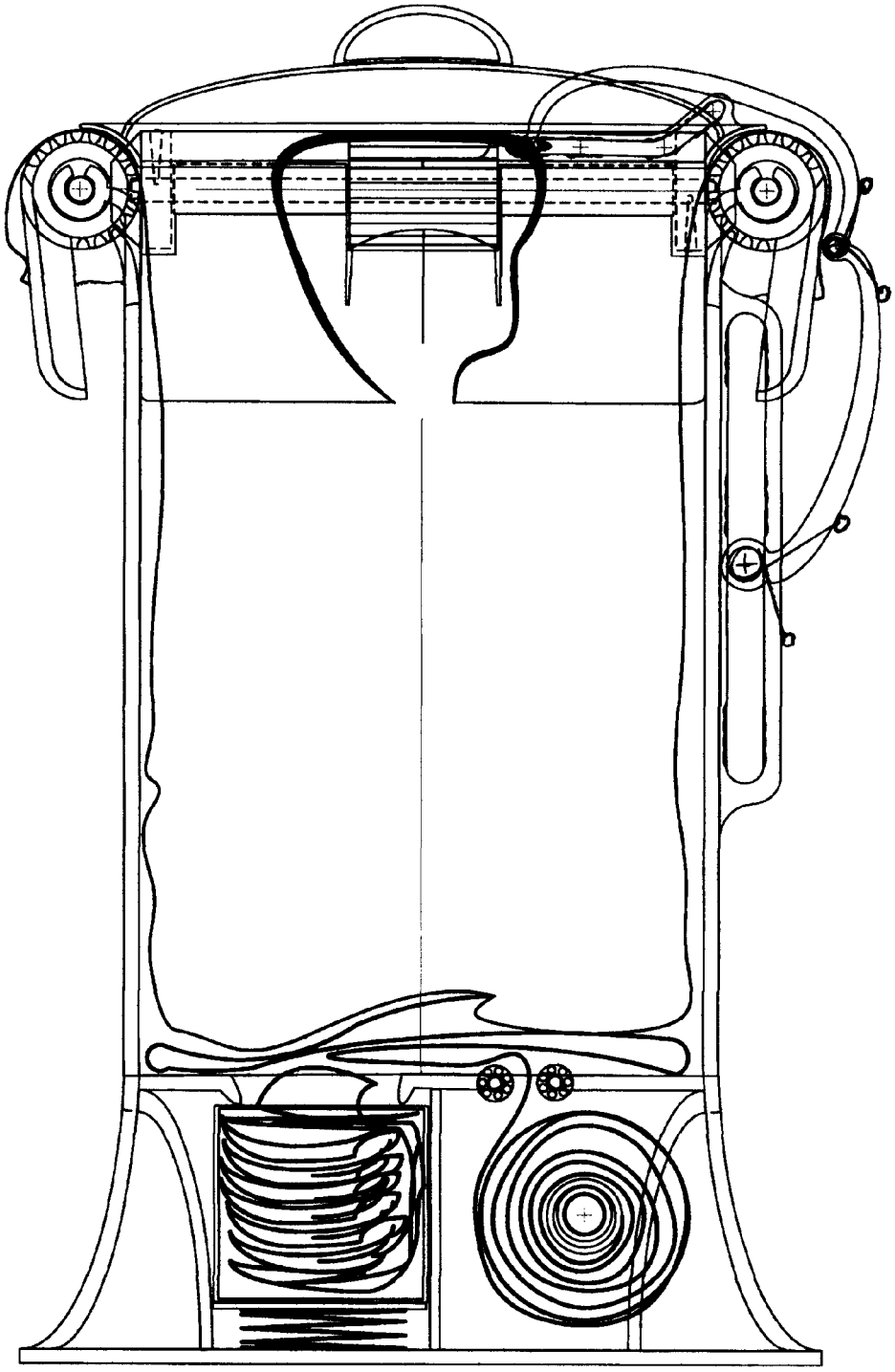
FIG. 16 is similar to FIG. 15 with different position of the rotary wings to adapt to the smaller size and capacity of the used supply media.

FIG. 16, moreover exposes the other possible position of the rotary wings, the lid in the closed position, and illustrates the flexibility of the gliding transformable mechanism.

FIG. 17 therein exposes the so called "wire model" of the adjustable trash receptacle, which demonstrates the simplicity of the waste management system design pattern. In particular said wire model shows the hub less spiral roll 119 supported, in this case, by a plurality of tubular prolonged bearings 160, said roll 119 loaded through the door or door less cavity 155, equipped in case it is the door with some kind of convenient handle 156. As mentioned earlier the openings or cavities 152, 153 help the user manage the state of the box 110 and roll 119 while dealing with the separation of the sack 121 from the feed 120, furthermore the prolonged bearings 150 help guide the supply media feed 120 up and out, to expose the sack 121 and its mouth 123 to the user.

It is obvious to those experienced in the Art that the plurality of figures and letters therein expose only few of many possible implementation variants of the waste management system architecture design pattern applied as the sample adjustable trash receptacle therein, furthermore the invention intent is to help those experienced in the Art come up with numerous flavors of the particular solutions or inherited designs based on, feed by, and grown from the novel ideas, patterns and concepts expressed by this novel invention, its letters and graphic figures, such that the wide variety of said flavors of particular implementations would be covered by the letters and figures of this invention.

I claim:

1. An universal adjustable garbage, trash or waste management system, operated by a user, said system uniquely characterized by and comprised of:

(a) a variable-size upper opening formed by a plurality of rotary wings synchronized by gears and controlled by a clickable mechanism preset in fixed angles by the user to achieve the required tension needed for the said variable size opening to conveniently adopt to size of mouth of wide variety of disposable supply media, including most brands, types and sizes of kitchen bags, plastic ties or trash sacks;

(b) a lid supported by a glider transformable mechanism keeping said lid readily available, at the user discretion, to proceed with cover or uncover acts of said variable size upper opening of the said system, said lid stays around a top and side region of the said system, said lid being fixed by said glider transformable mechanism, with the user help, in a position most convenient for the user to perform waste management and other activities involving said system;

(c) a supply media feeder forming the foundation of the said system, said feeder able to host in and feed out a plurality of supply media types of disposable items such as said bags, ties or sacks often compacted as a sequential collection of said disposable items in a box, or in a sequential, sometimes pre-perforated along separation lines, feed in a roll, said box or roll forming a plurality of said types;

(d) a container stomach of the said system, said stomach able to contain said bags, ties or sacks in their expanded and furthermore filled form, said stomach optionally having a plurality of doors and/or cavities optionally overlapping with the said supply media feeder area across the level of the said stomach and said feeder separation panel, as needed for the user convenience to load the supply media and maintain it together with overall stability of the said system during its operation;

(e) a collection of components, including but not limited to those mentioned in (a), (b), (c), and (d) herein, said components collaborate together shaping a universal architecture design pattern for a plurality of garbage, trash or waste management systems.

2. The system of claim 1 in which a plurality of its components are transparent to any degree of transparency from full to none.

3. The system of claim 2 in which a plurality of its components appear in a variety of highly attractive, bright or glowing colors in an attempt to increase the usage of the said system by younger generation users to help them establish a good habit of properly disposing and maintaining waste.

4. The system of claim 2 in which a plurality of its components embed optionally colorful mirrors or other electro-magnetic waves reflecting means to achieve a kaleidoscope-like and other attractive effects.

5. The system of claim 2 in which a plurality of components depict popular heroes, scenes and subjects of movies, cartoons, culture and art.

6. The system of claim 2 in which a preferably the clickable mechanism or other components of the said system embed the electricity generation means sufficient to enlighten a plurality of electro-magnetic, including and not limited to a visible light spectrum, emitting means.

7. The system of claim 6, which preferably employs a plurality of high-efficiency LED (light emitting diode).

8. The system of claim 6 optionally employing a plurality of sound-generation means including a plurality of speech producing means which may or may not respond to the user actions or voice patterns.

9. The system of claim 2 optionally having the user-driven, preferably downwards-erectable means, to extend a plurality of wheels to help carry and move the said system around its area of service, at the user discretion and convenience.

10. The system of claim 9 preferably combined with electricity generating elements mentioned in claim 6, and, optionally, with additional electricity generating means driven by the wheels mentioned in claim 9, to possibly energize an additional light emitting means, preferably a plurality of high-energy LED-s to enlighten the path of the system on the move, especially in the dark, for the increased user safety and convenience.

11. The system of claim 10 with additional means to produce warning sounds and highly visible, possibly intermittent flashlights, while the said system is on the move for increased safety.

12. The system of claim 2 with additional early warning sensors and logic elements allowing to visually and audibly warn the user in case there is an occurrence of the waste leak, or other hazardous condition in the system or in its content.

* * * * *